US010190823B2

(12) United States Patent
Hoyt et al.

(10) Patent No.: US 10,190,823 B2
(45) Date of Patent: Jan. 29, 2019

(54) HIGH TEMPERATURE REACTOR REFRACTORY SYSTEMS

(71) Applicant: Allied Mineral Products, Inc., Columbus, OH (US)

(72) Inventors: Timothy L. Hoyt, Marysville, OH (US); Dana Goski, Upper Arlington, OH (US); Anthony DiSaia, Powell, OH (US); David M. Knoll, Jr., Galloway, OH (US); Robert L. Wilson, West Jefferson, OH (US)

(73) Assignee: ALLIED MINERAL PRODUCTS, INC., Columbus, OH (US)

( * ) Notice: Subject to any disclaimer, the term of this patent is extended or adjusted under 35 U.S.C. 154(b) by 694 days.

(21) Appl. No.: 14/543,879

(22) Filed: Nov. 17, 2014

(65) Prior Publication Data

US 2015/0136001 A1 May 21, 2015

Related U.S. Application Data

(60) Provisional application No. 61/904,735, filed on Nov. 15, 2013.

(51) Int. Cl.
*F27D 1/10* (2006.01)
*F27D 1/00* (2006.01)
(Continued)

(52) U.S. Cl.
CPC ..... *F27D 1/10* (2013.01); *F27B 15/06* (2013.01); *F27D 1/0006* (2013.01);
(Continued)

(58) Field of Classification Search
CPC .. F27D 1/045; F27D 2001/047; F27D 1/0023; F27D 1/003; F27D 1/004;
(Continued)

(56) References Cited

U.S. PATENT DOCUMENTS 2,856,343 A 10/1958 Coleman et al.
4,073,703 A 2/1978 Kinosz et al.
(Continued)

FOREIGN PATENT DOCUMENTS

EP 1445300 8/2004
GB 1270660 4/1972
(Continued)

OTHER PUBLICATIONS

JP 06031435—Machine Translation, retrieved on Mar. 2017.*
(Continued)

*Primary Examiner* — David J Laux
(74) *Attorney, Agent, or Firm* — Porter Wright Morris & Arthur LLP

(57) ABSTRACT

A fluidized bed system having a containment vessel, a precast and predried monolithic refractory floor module positioned in the vessel, and a plurality of precast and predried monolithic refractory wall modules stacked within the vessel. The plurality of wall modules includes a first wall module is positioned on the floor module, wherein the floor module and the first wall module have interlocking surfaces, and wall modules adjacent to one another have interlocking surfaces. A method for assembling a fluidized bed reactor is also provided.

19 Claims, 14 Drawing Sheets

(51) Int. Cl.
*F27D 1/04* (2006.01)
*F27D 1/16* (2006.01)
*F27B 15/06* (2006.01)

(52) U.S. Cl.
CPC ..... *F27D 1/0043* (2013.01); *F27D 1/045* (2013.01); *F27D 1/1621* (2013.01); *F27D 2001/047* (2013.01); *Y10T 29/49623* (2015.01)

(58) Field of Classification Search
CPC ..... F27D 2001/0053; F27D 2001/0056; F27D 1/00; F27D 1/0043; F27D 1/1621; F27D 1/10; F27D 1/0006; F23M 5/00; F27B 15/06
USPC ..... 110/336, 338, 180
See application file for complete search history.

(56) References Cited

U.S. PATENT DOCUMENTS 4,308,116 A 12/1981 Andreassen et al.
4,560,449 A 12/1985 Sivilotti
4,960,501 A 10/1990 Sivilotti
5,033,721 A * 7/1991 Gnyra ..... B22D 41/02 266/280
5,034,197 A 7/1991 Potinkara
5,137,603 A 8/1992 Arthur et al.
5,423,152 A 6/1995 Kolvek
5,429,722 A 7/1995 Cullen
5,565,080 A 10/1996 Peacey et al.
5,779,989 A 7/1998 Tomasicchio et al.
6,358,393 B1 3/2002 Berclaz et al.
6,458,732 B1 10/2002 Doza et al.
6,540,510 B1 * 4/2003 Abdullah ..... C10J 3/00 432/247
6,893,992 B2 5/2005 Doza et al.
7,827,689 B2 11/2010 Crane et al.
8,685,122 B2 * 4/2014 Murakami ..... F23C 10/10 48/61
2011/0117729 A1 * 5/2011 Osborne ..... C23C 16/24 438/478
2012/0266826 A1 10/2012 Stephan et al.
2013/0012633 A1 1/2013 Jiang
2013/0126339 A1 * 5/2013 Hoyt ..... C25C 7/005 204/242

FOREIGN PATENT DOCUMENTS

JP 06031435 A * 2/1994
JP 2004053166 2/2004
JP 2007327742 12/2007
WO 9514119 5/1995
WO WO-9738140 A1 * 10/1997 ..... C21B 7/04

OTHER PUBLICATIONS

Elmtherm Data Sheet (undated, available prior to Nov. 17, 2011).
Elmelec GM 40 SRP Data Sheet (undated, available prior to Nov. 17, 2011).
International Search Report for PCT/US2014/066012, dated Mar. 13, 2015.
Written Opinion of the International Searching Authority for PCT/US2014/066012, dated Mar. 13, 2015.
English Abstract of JP2007327742, Dec. 20, 2007.
English Abstract of JP2004053166, Feb. 19, 2004.

* cited by examiner

HIGH TEMPERATURE REACTOR REFRACTORY SYSTEMS

CROSS REFERENCE TO RELATED APPLICATIONS

This application claims priority to U.S. Provisional Patent Application No. 61/904,735, filed on Nov. 15, 2013, entitled "High Temperature Reactor Refractory Systems." The entire disclosure of the foregoing provisional patent application is incorporated by reference herein.

BACKGROUND

The present disclosure relates to high temperature fluidized bed systems, particularly fluidized bed reactors such those used in the production and recovery of metals, metal oxides, and chemical conversion products of materials, as well as in energy generation conversion units.

Various ores (e.g., titanium-bearing ores, ferrous ores, etc.), coal, slags and metals are processed in high temperature fluidized beds. Fluidized bed systems are also used for coking, as well as for chlorination of feedstock. Power plants also employ high temperature fluidized beds, such as those used in biomass high temperature energy conversion, waste-to-energy systems, organic fuel processing, and recycled fuel operations. There are several types of reactor beds: fixed bed, slurry bed, fluidized bed boilers, circulating fluidized beds and bubbling fluidized beds. Typically, circulating fluidized bed boilers are more efficient than bubbling fluidized beds since particulate and reactants are mixed at a higher velocity and react more efficiently with better conversion rates than low particle velocity bubbling fluidized beds.

Typically, fluidized bed systems have a dense hot face, or working lining, made of refractory fire brick, perhaps several rows, as well as back up layers of insulating fire brick between the steel shell and the refractory brick lining. The size of these bricks are traditionally such that a single person can easily handle a brick, a classic example being 4.5 inches in width by 9 inches in length and 3 inches in thickness. The refractory bricks are mortared together. However, even with the advent of super dense, low porosity, hot face brick created to last longer in service, the mortar is still the weakest link in the refractory process. The mortar is the prominent source of failure. When the mortar fails, the bricks begin to corrode at those contact areas lacking mortar and, with time, shift and fall out of place. In addition, the production unit of the fluidized bed tends to vibrate during service, and that movement is an additional contributor to mechanical failure at the mortar-brick contact surface.

In fluidized bed reactors which operate hot enough to require the use of ceramic refractories where acids are present, the refractory bricks can also act as a physical and thermal protection barrier to acid reactions with the outer steel shell of the fluidized bed reactor containment unit. A joint failure in these reactors provides an access route for corrosive gases to migrate more easily to the steel shell and condense upon it, potentially degrading the steel shell.

Other problems with current refractory brick designs used in fluidized bed reactors include:

- lack of a strong mortar bonding on high fired brick, particularly in the case of extremely high fired brick which has extremely low porosity which makes it nearly impossible for mortar to bond well with the brick face;

- a high number of mortar joints exist in the lining with potential for early failure at all of them;
- mortar joints at each bonding face of tile or mortar are areas of low strength, high porosity and lower chemical resistance than the brick;
- vibration movement commonly experienced by entire containment vessel during processing allows for debonded tile or brick to shift and eventually fall out, collapsing regions of side walls in the combustor zone;
- abrasion from the fluidizing media and particulate matter will wear the mortar joints;
- tiles or brick require joints, mortar and labor for installation, an exceptionally labor intensive process;
- the mortar must be allowed to dry after the brick have been placed to a critical stack height to prevent wall collapse which adds time; and/or
- dry out is required to eliminate moisture from the mortar, along with the possibility of moisture release or inclusion of moisture in the chemical process which can reduce the reaction speed and/or contaminate the process.

While a variety of devices and techniques may exist for fluidized bed reactor systems, it is believed that no one prior to the inventors have made or used an invention as described herein.

BRIEF DESCRIPTION OF THE DRAWINGS

While the specification concludes with claims which particularly point out and distinctly claim the invention, it is believed the present invention will be better understood from the following description of certain examples taken in conjunction with the accompanying drawings. In the drawings, like numerals represent like elements throughout the several views.

Figure 1:
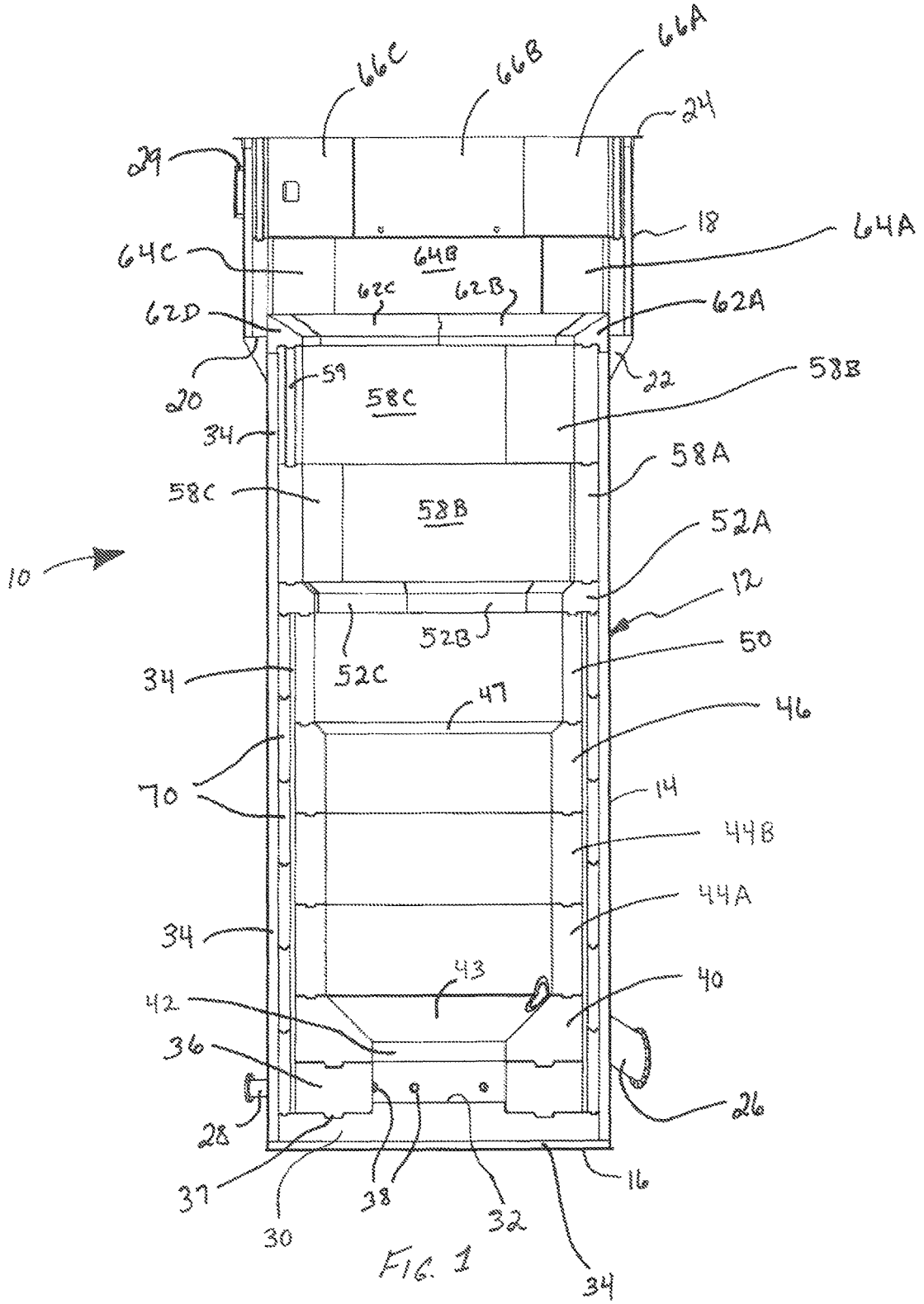
FIG. 1 depicts a cross-sectional view of a fluidized bed system.

The drawings are not intended to be limiting in any way, and it is contemplated that various embodiments of the invention may be carried out in a variety of other ways, including those not necessarily depicted in the drawings. The accompanying drawings incorporated in and forming a part of the specification illustrate several aspects of the present invention, and together with the description serve to explain the principles of the invention; it being understood, however, that this invention is not limited to the precise arrangements shown.

DETAILED DESCRIPTION

The following description of certain examples should not be used to limit the scope of the present invention. Other features, aspects, and advantages of the versions disclosed herein will become apparent to those skilled in the art from the following description, which is by way of illustration, one of the best modes contemplated for carrying out the invention. As will be realized, the versions described herein are capable of other different and obvious aspects, all without departing from the invention. Accordingly, the drawings and descriptions should be regarded as illustrative in nature and not restrictive.

The present disclosure provides high temperature fluidized bed systems which may be used, for example, in the production and recovery of metals, metal oxides, or chemical conversion products of materials, as well as in various energy generation conversion units. Embodiments described herein can be assembled faster and more efficiently than previous designs, and can be configured to allow for simplified replacement of one more components of a fluidized reactor unit.

Embodiments of the fluidized bed systems described herein generally comprise at least one precast and predried monolithic refractory floor module, a plurality of precast and predried monolithic refractory wall modules, and optionally one or more precast, predried monolithic refractory ceiling modules (or, alternatively, a metal lid or other covering secured, for example, to the containment vessel). The refractory floor and wall modules are assembled within a containment vessel (e.g., formed of a metal such as steel), thus forming a reactor unit. The refractory modules provide the working lining of the reactor, and have interlocking surfaces which not only facilitate assembly, but also improve the sealing of the modules to one another.

In some embodiments, the modules are completely backed-up by dry vibratable refractory material located between the outer walls of the precast refractory modules and the containment vessel. In further embodiments, the precast refractory modules providing the working lining are backed by a row of secondary insulating refractory modules, also precast and predried. In some embodiments, the secondary insulating refractory modules also include interlocking surfaces. In still further embodiments, dry vibratable refractory material is located between the primary modules (i.e., the modules providing the working lining) and the secondary insulating refractory modules, and another layer of dry vibratable refractory material may also be provided between the secondary insulating refractory modules and the containment vessel. Several combinations of precast predried monolithic shapes and optional use of dry vibratable are described herein. The dry vibratable is moisture free; however, a castable, grout or mortar can be used to fill any gaps between warped or imperfectly shaped steel shells.

One particular embodiment is a high temperature fluidized bed reactor comprising at least one precast and predried monolithic refractory floor module, a plurality of precast and predried monolithic refractory wall modules, and optionally one or more precast, predried monolithic refractory ceiling modules. Input and output ports (e.g., for municipal waste, mineral ores, powdered feedstock to be converted to or from a metal oxide, primary air, secondary air, reaction gas, reactants and/or finished product) are pre-fabricated into the modules, as well as, where desired or necessary, access holes and various other passageways. The input and output ports and other passageways may also be lined with pipe or other suitable conduit, including terminating flanges and the like, particularly at the exterior terminus or the port or other passageway.

In some embodiments described herein, adjacent surfaces all of the adjacent refractory modules are configured to have interlocking surfaces, while in other embodiments certain adjacent modules do not interlock with one another. The interlocking surfaces can be provided by any of a variety of shapes, particularly mating shapes provided on adjacent surfaces so as to not only facilitate assembly and alignment, but also improved sealing (even with less mortar between adjacent surfaces).

Embodiments described herein utilize large, precast refractory components as not only the working lining of the reactor volume, but also as an insulating layer between the interior volume of the reactor and the outer containment vessel (also known as the outer shell). In some embodiments, this eliminates over 80% of the mortar joints as compared to conventional working linings. In cylindrical column fluidized bed reactors, for example, the working lining can be precast as a cylinder or partial cylinder segments. By way of further example, each of the wall modules of the working lining can be formed from quarter cylinder segments having interlocking interfaces.

The monolithic materials chosen can be zoned within the assembly to optimize performance in different chemical reaction zones within the fluidized bed reactor. For example, different refractory materials can be used in the combustor or fluidized bed region (e.g., thicker, more dense and/or more heat conductive) as compared to the freeboard or other region above the combustor region. The size of the precast modules can also be chosen to meet a variety of needs, such as, for example, access door or opening area to the interior of the reactor (e.g., a taller module in areas needing access doors or openings), as well as crane or vacuum lifting equipment maximum load capability.

While exemplary embodiments are shown herein as being cylindrical in nature, and circular in cross-section, the fluidized bed reactors described herein can be of any shape, e.g., square or rectangular cross-section, or change in shape at different stages of the reactor. Thus, the modules and assembled module segments can be of any annular shape such as circular, oval, square, rectangular, etc., and the term "ring" or "ring-shaped," as used herein, includes (unless otherwise specified) any annular shape such as circular, oval, square, rectangular, etc.

Figure 2:
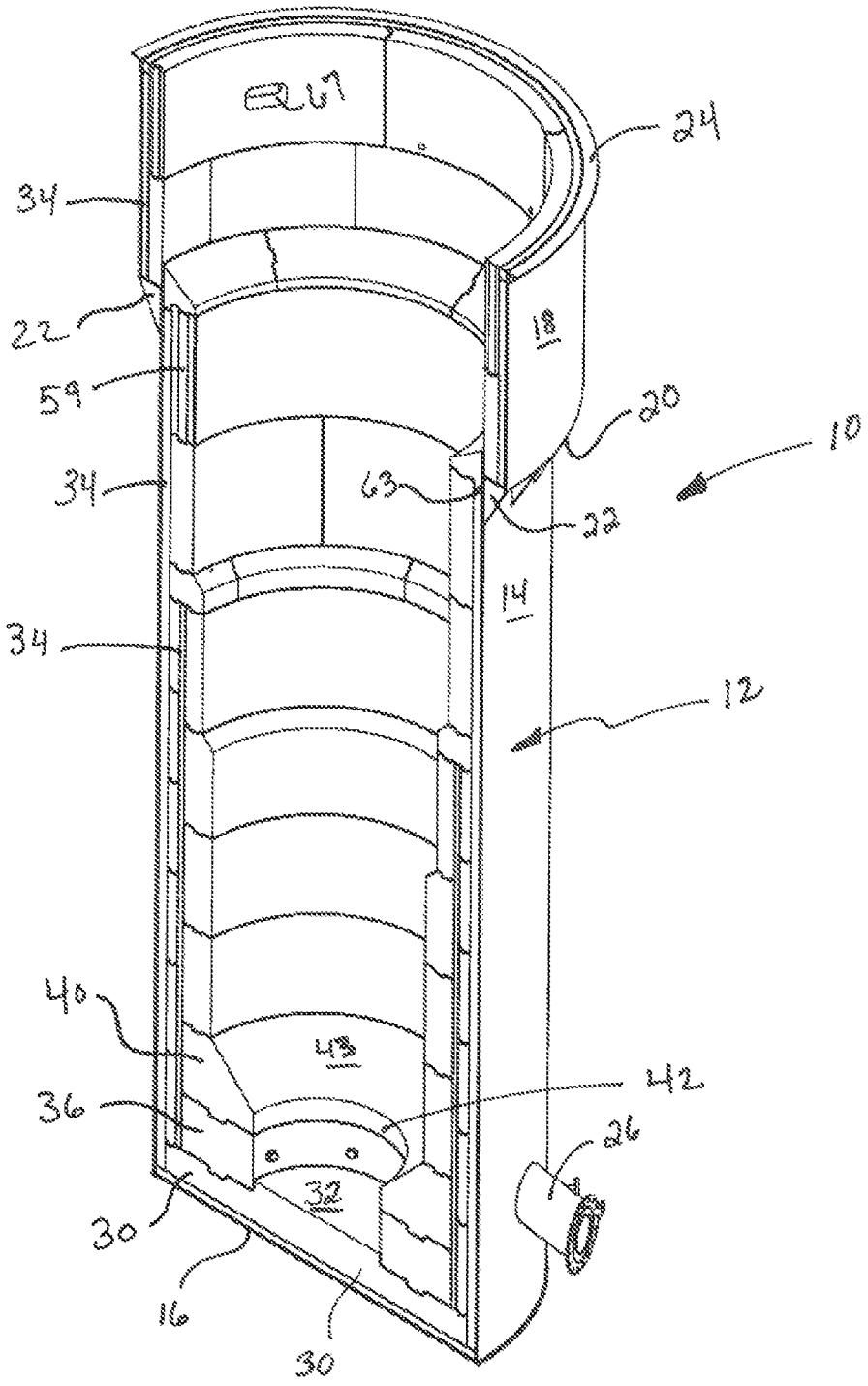
FIG. 2 depicts an elevational cross-sectional view of the fluidized bed system of FIG. 1.
Figure 3:
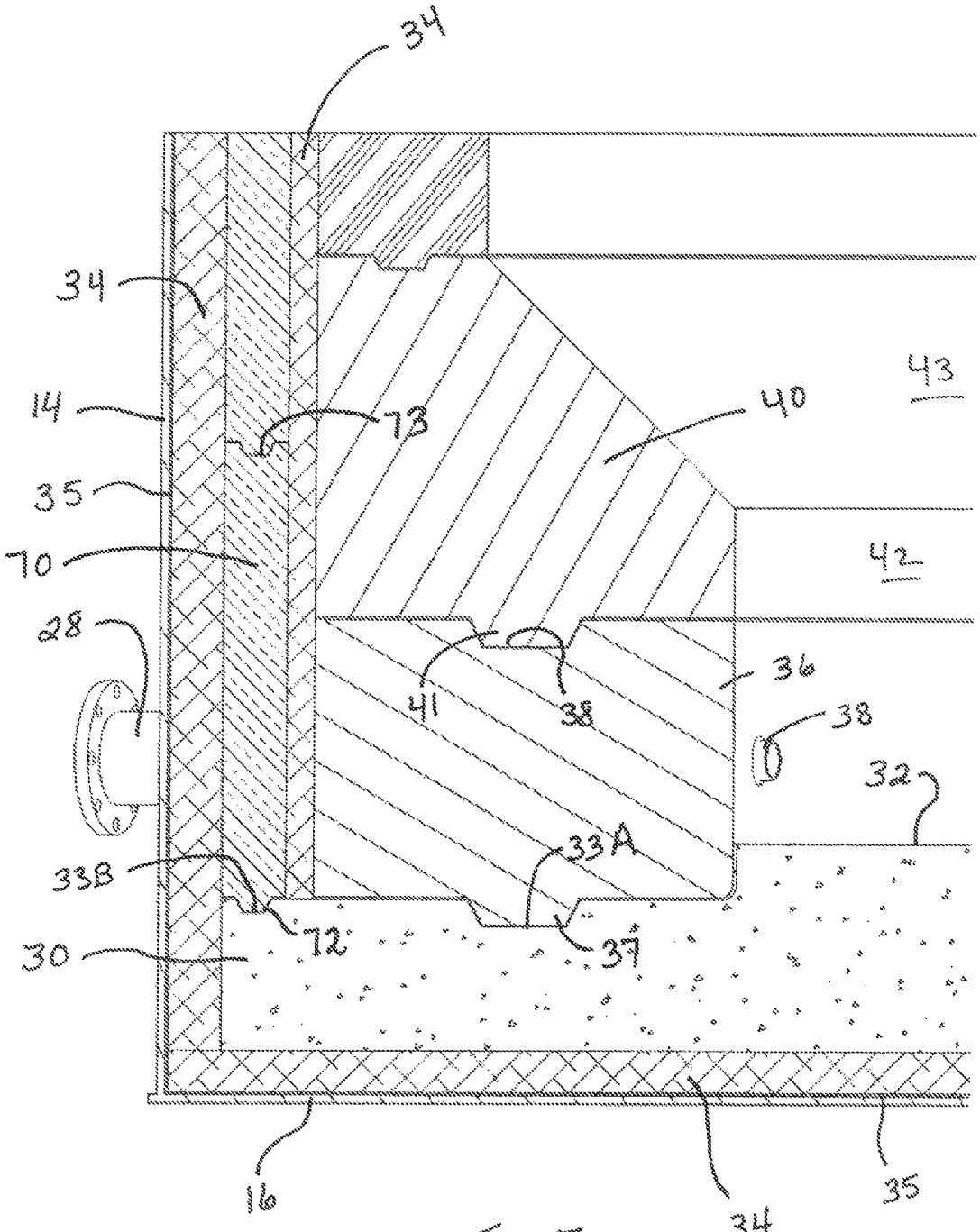
FIG. 3 depicts a cross-sectional view of a portion of the fluidized bed system of FIG. 1.

FIGS. 1 and 2 are cross-sectional views of a high temperature fluidized bed reactor (10) according to one embodiment of the present disclosure. Reactor (10) is used, for example, as a mineral purification or conversion vessel, such with chlorination, oxidation or sulfur dioxide. FIG. 3 is an enlarged view of the lower left corner of the view of FIG. 1. It will be understood that the other half of reactor (10) (not shown) is identical to the half shown, apart from the various optional conduits.

Reactor (10) includes a metal (e.g., steel) shell (12) having a sidewall (14) welded to a bottom (16), thus providing a cylindrical cavity in which the various modules and other components are located. An upper sidewall (18) of shell (12) is located at the upper end of sidewall (14), and has a larger diameter than the lower sidewall (14). A support flange (20) extends around the outer circumference of the shell (12), at the base of upper sidewall (18), and is welded to the lower sidewall (14) using triangular support gussets (22), as shown. An upper end flange (24) is also provided on shell (12), and may be used to secure a cover to reactor (10).

An exit port for solids, or alternatively a feed input pipe (26) extends through sidewall (14) of steel shell (12), and is flanged on its exterior end for connection to a product reactant collection vessel if it is an exit port, alternately a storage feed vessel if it is an input pipe. A plurality of primary and secondary air, gaseous carrier or reactant or reactant feed intake pipes (28) also extend through sidewall (14) of steel shell (12), and are similarly flanged on their exterior ends for connection to air or gas distributor feed-pipes or a feed supply system. Although not depicted, as is known to those skilled in the art, a distributor plate may be included at the base of the reactor interior, particularly where intake pipes (28) are used to supply air to the reactor.

At the upper end of reactor (10), a gas offtake, dust collector or reactant offtake port (29) which goes to a secondary collection system extends through upper sidewall (18) of shell (12) for dust collection, recycling, or to supply another vessel for product refinement or storage. These pipes are merely exemplary, as any number and arrangement of supply pipes, conduits and similar features may extend through steel shell (12), as desired for a particular application.

A precast and predried monolithic refractory floor module (30) is located atop bottom (16) of steel shell (12). In the particular embodiment depicted, a layer of dry vibratable refractory material (34) is positioned between the floor module (30) and the bottom (16) in order to, for example, level the shape due to warping of the steel shell and/or to provide thermal insulation depending upon the thickness of the layer. Vibratable refractory material (34) is also optionally provided between the refractory wall modules and the sidewalls (14,18) of steel shell (12). During installation the dry vibratable material is leveled and compacted in place. In addition, insulating paper, mica and/or microporous insulation (35) may optionally be provided between the vibratable refractory material (34) and the steel shell (12) (see FIG. 3) (or between the floor and wall modules and the steel shell when the vibratable refractory material is not employed).

It should also be noted that the in some embodiments, the floor module is not flat but rather is conical in shape, and as such, a conical precast or segments thereof can be utilized in place of a flat flooring module.

Figure 4:
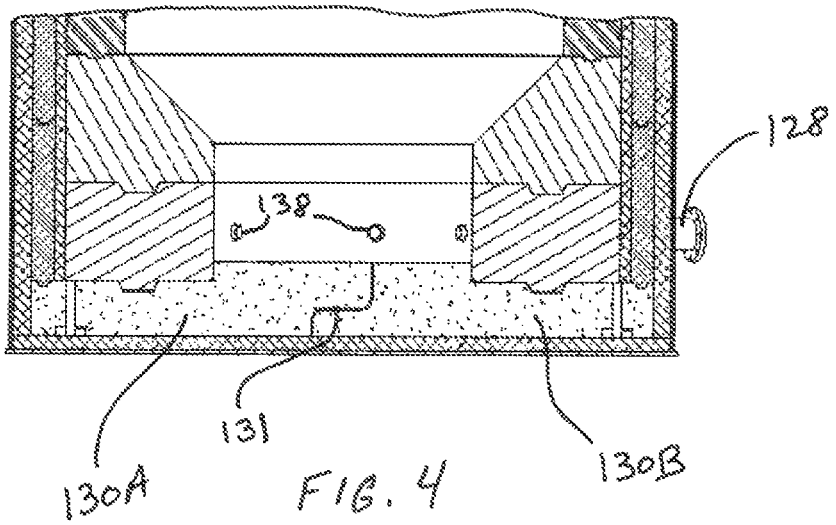
FIG. 4 depicts a cross-sectional view of an alternative embodiment of a portion of a fluidized bed system.

Floor module (30) has an outer circumferential shape approximating that of the interior of the base of shell (12), such as the circular shape depicted. Floor module (30) may be cast as a single monolithic piece, or may be fabricated from two or more segments having interlocking adjacent surfaces, such as depicted in the alternative embodiment shown in FIG. 4. Floor module (130) in FIG. 4 comprises two half-circle segments (130A, 130B), which interlock with one another at joint (131), which, in the example shown, is a shiplap or rabbet joint. It will be understood that any of a variety of other interlocking surface arrangements may be employed, as further described herein.

Floor module (30) includes a central raised portion (32) which, in the example shown, is circular in shape. The outer circumference of central raised portion (32) is slightly less than the interior circumference of the first wall module (36) such that central raised portion (32) facilitates alignment of first wall module (36) and also provides additional sealing area between the floor (30) and the first wall module (36).

Floor module (30) also includes first and second circumferential grooves (33A, 33B) in its upper surface, concentric to each other and the central raised portion (32). First and second circumferential grooves (33A, 33B) are configured for mating engagement with circumferential projections (37) and (72) extending downwardly from the bottom endwall of first wall module (36) and the lowermost secondary insulating refractory module (70), respectively. (See FIG. 3) Where secondary insulating refractory modules are not employed, the second circumferential groove (33B) may be omitted. The mating engagement of first and second circumferential grooves (33A, 33B) with circumferential projections (37) and (72) not only help to facilitate proper alignment during assembly, but also provide greater sealing (particularly when mortar is applied between adjacent surfaces of the modules, including within the circumferential grooves. Once again various other shapes can be employed for the interlocking surfaces provided by first and second circumferential grooves (33A, 33B) and mating circumferential projections (37) and (72).

Precast and predried monolithic refractory wall modules (36, 40, 44, 46, 50, 52, 58, 62) are stacked sequentially atop floor module (30) within steel shell (12), as shown. Each wall module may be cast as a unitary ring (e.g., a circular ring, as shown), or may be cast as a plurality of ring segments having interlocking side surfaces. Various conduits, openings or other passageways may be molded into one or more of the wall modules, as desired. In addition, a pipe (e.g., a steel pipe) or other conduit may be inserted into the mold prior to casting of the wall module in order to provide the desired conduit, such as to mate with a pipe or other conduit extending through the outer shell (12). Alternatively, pipes or other conduits may be inserted into passageways molded into the module after casting, and sealed in place (e.g., using mortar). In the example shown, conduits (38) are provided in first wall module (36), in fluid alignment with pipes (28) extending through sidewall (14) of shell (12). Conduits (28) provide inert or reactant gas intake, air intake or feedstock supply. In the case where conduits (28) provide air or other gas for fluidization, a distributor plate may be positioned above the interior outlet of conduits (28), such as within the inner diameter of first wall module (36).

First wall module (36) is ring-shaped, having an outer circumference smaller than the outer circumference of floor module (30), as shown. As mentioned previously, circumferential projection (37) extends downwardly away from the bottom endwall of first wall module (36), and is sized, shaped and located for mating engagement with first groove (33A) of floor module (30), as shown. Similarly, a circumferential groove (38) extends upwardly away from the upper endwall of first wall module (36), and is sized, shaped and located for mating engagement with a circumferential projection (41) which extends downwardly away from the bottom endwall of second wall module (40). Subsequent wall modules have similar arrangements of mating grooves and projections which not only facilitate alignment during assembly, but also provide enhanced sealing, particularly when mortar is applied between mating surfaces of wall modules.

The wall modules may have varying heights, wall thicknesses and internal circumferences, as desired. For example, thicker wall modules may be employed near the bottom of the reactor to provide additional heat resistance and strength, while wall modules with a greater interior circumference are provided nearer the top of the reactor in order to facilitate entry into and/or repair of components inside the working lining of the vessel or to add feedstock potentially from the roof such that the feedstock reacts as it falls into the vessel.

In order to provide smooth transitions between changes in interior circumference (i.e., diameter) of the reactor volume, one or more wall modules may include a draft (i.e., tapered) portion. Thus, second wall module (40) includes a cylindrical, constant diameter lower portion (41) and an upper portion (42) having an outwardly tapered interior circumference. Thus, the interior diameter of reactor (10) is smaller at lower portion (41) of second wall module (40), and increases in the upper portion (42) of second wall module (40). The working diameters for the various regions of the reactor may be optimized for the particular operating conductions of the fluidized bed.

Figure 5:
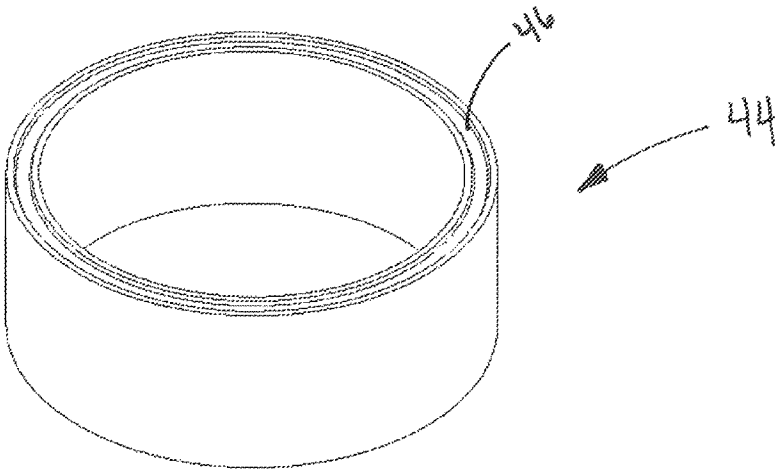
FIG. 5 depicts a wall module for use in the fluidized bed system of FIG. 1.
Figure 6:
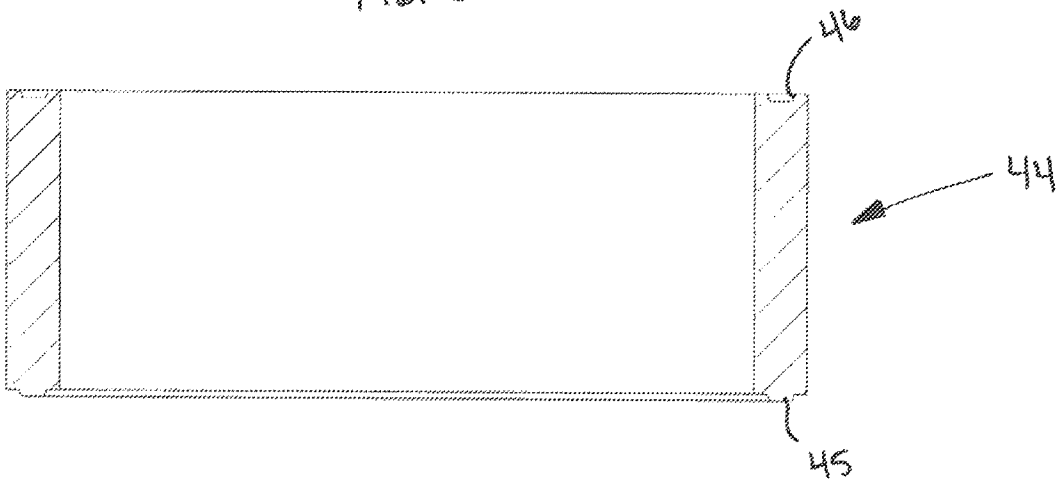
FIG. 6 depicts a cross-sectional view of the wall module of FIG. 5.
Figure 7:
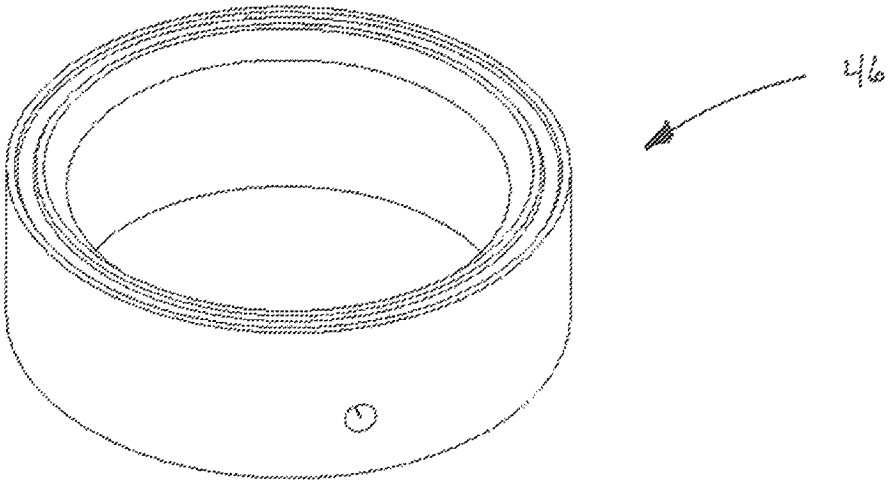
FIG. 7 depicts another embodiment of a wall module for use in the fluidized bed system of FIG. 1.
Figure 8:
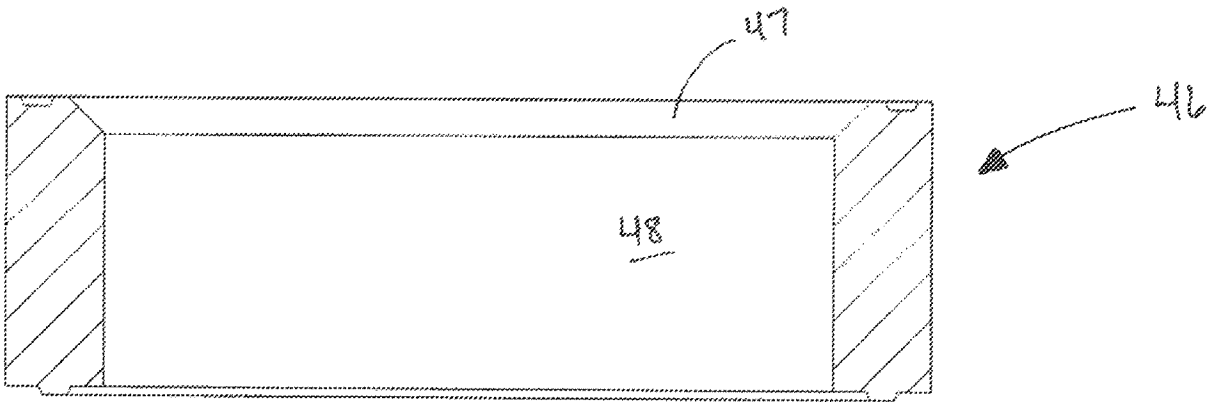
FIG. 8 depicts a cross-sectional view of the wall module of FIG. 7.

Continuing upwardly, third and fourth wall modules (44A, 44B), shown in FIGS. 5 and 6, have a constant interior diameter equivalent to that of the upper end of second wall module (40). As before, a circumferential projection (45) extends downwardly away from the bottom endwall of wall module (44), and is sized, shaped and located for mating engagement with a corresponding groove in the upper endwall of second floor module (40) or groove (46) in the upper endwall of an adjacent wall module (44), as shown.

Fifth wall module (46) is positioned atop fourth wall module (44B), as shown. Like second wall module (40), fifth wall module (46) includes an upper, tapered interior wall portion (47), and a lower interior wall portion (48) of constant interior diameter. A mating projection and groove are also once again provided in the lower and upper endwalls of wall module (46).

Sixth wall module (50) is similar to wall modules (44A, 44B), albeit with a smaller interior diameter and wall thickness. As before, sixth wall module (50) includes the interlocking features such as a groove in its upper endwall, and a similarly shaped projection extending from its bottom endwall.

Figure 9:
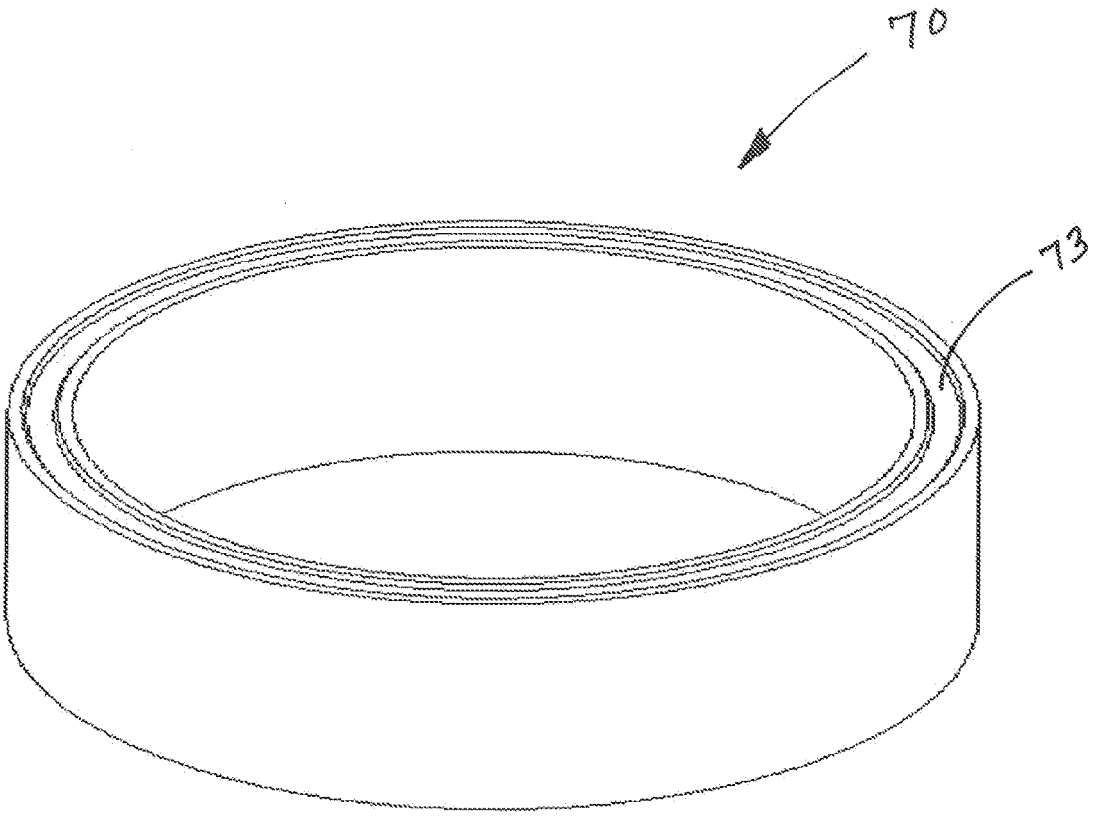
FIG. 9 depicts an insulating module for use in the fluidized bed system of FIG. 1.
Figure 10:
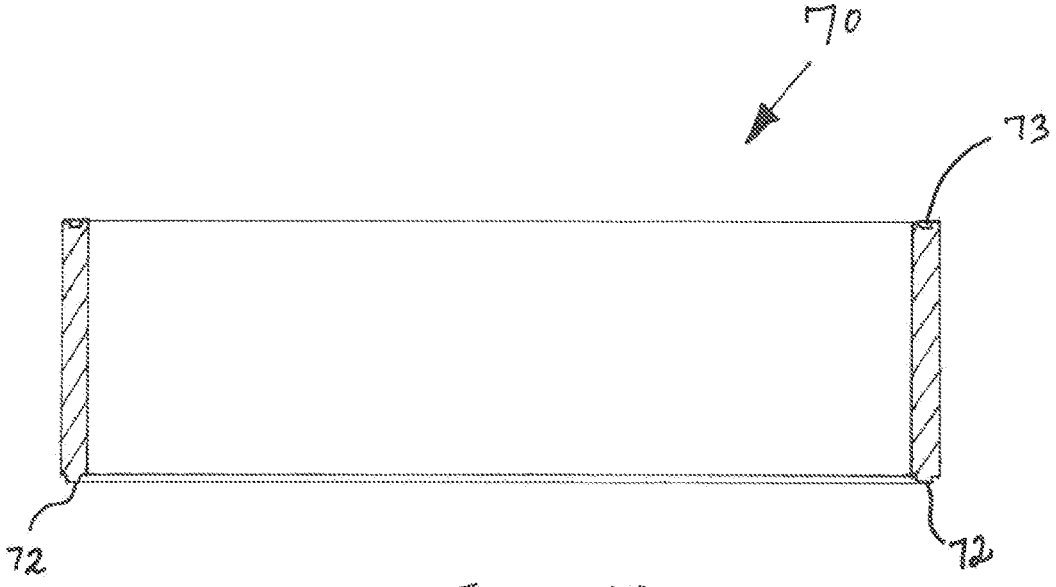
FIG. 10 depicts a cross-sectional view of the insulating module of FIG. 9.

Before discussing the additional wall modules, it may be helpful to first look at the optional secondary insulating refractory modules, which are also precast and predried and include interlocking surfaces. FIGS. 9 and 10 depict an exemplary secondary insulating module (70), which is cylindrical in shape and includes circumferential projection (72) extending downwardly from the bottom endwall of insulating module (70) and a circumferential groove (73) in its upper endwall. The circumferential projection (72) extending downwardly from the bottom endwall of the lowermost insulating module (70) is configured for mating engagement with the second circumferential groove (33B) in the upper surface of floor module (30). Similarly, the groove (73) is configured for mating engagement with the circumferential projection (72) extending downwardly from the bottom endwall of an adjacent insulating refractory module (70) such that any number of modules (70) may be stacked atop one another.

The inner diameter of insulating modules (70) is slightly greater than the outer diameter of the wall modules (36, 40, 44, 46, 50), allowing vibratable refractory material to be added to the space between insulating module (70) and the wall modules, as well as to accommodate warped outer shells (12). Similarly, the outer diameter of insulating modules (70) is slightly greater than the inner diameter of shell (12), also allowing vibratable refractory material to be added to the space between insulating module (70) and the interior of the shell (12). Among other things, the use of dry vibratable monolithic refractory allows for easier installation, particularly in warped, bowed or out of round steel shells.

As best seen in FIG. 1, the interface of adjacent insulating modules (70) is vertically offset from the interface of adjacent wall modules in order to provide increased strength and hinder material which leaks between adjacent wall modules from reaching the outer shell (12). Also, conduits or other passageways may be provided in the insulting modules (70), as necessary or desired, as described previously with respect to the wall modules.

While the reactor systems of the present invention may be configured in a wide variety of heights and diameters, with any number of wall modules and, optionally, insulating modules, the lower section of the reactor (10) shown in FIGS. 1 and 2 includes six unitary (unsegmented) wall modules (36, 40, 44A, 44B, 46, 50) and six unitary insulating modules (70) surrounding the wall modules within shell (12). The sixth wall module (50) and uppermost insulating module (70) terminate at approximately the same height, and are both capped by a segmented, intermediate wall module (52). Intermediate wall module (52) can be precast and predried as a single, unitary, ring-shaped module. In the embodiment depicted, however, intermediate wall module (52), as well as the wall modules located above it, are segmented. In other words, although intermediate wall module (52), when assembled, is ring-shaped, it is formed from individual precast and predried casted segments which are joined together at their interior endwalls to form the ring structure. In the example shown, intermediate wall module (52) is formed from five identical wall segments (52A-E). Of course it will be understood that intermediate wall module (52) as well as the other wall modules can be formed from any number of segments, such as 2 to 6 segments, or 3-5 segments.

Intermediate wall module (52) has a cross-sectional wall thickness W (FIG. 12) which is approximately equal to the combined width of the wall thickness of sixth wall module (50), the wall thickness of insulating module (70) and the width of vibratable material between sixth wall module (50) and insulating module (70). A circumferential groove (72) is provided in the upper endwall of wall segments (52A-E), as well as first and second circumferential projections (54A, 54B), concentric to each other, and extending downwardly from the bottom endwall of wall segments (52A-E). First circumferential projection (54A) is configured for mating engagement with the circumferential groove in the upper surface of sixth wall module (50). Second circumferential projection (54B) is configured for mating engagement with the circumferential groove (73) in the upper surface of the insulating module (70) which surrounds sixth wall module (50). Circumferential groove (72) is configured for mating engagement with a wall module (e.g., wall module (58)) positioned atop intermediate wall module (52). Thus, intermediate wall module (52) essentially caps the sixth wall module (50) and uppermost insulating module (70).

The side endwalls of intermediate wall segments (52A-E) are also configured for interlocking engagement with one another. In the exemplary embodiment shown, a groove (55) is provided on a proximal side endwall of wall segment (52A), extending between the bottom and upper endwalls of the segment. A mating projection (i.e., a ridge) (56) is provided on the distal side endwall of wall segment (52A), and also extends between the bottom and upper endwalls of the segment. Intermediate wall segments (52A-E) can thus be assembled into the overall ring shape of intermediate wall module (52) by engaging each groove (56) of a wall segment (52A-E) in the groove (55) of an adjacent wall segment (52A-E). Like the interlocking arrangements described previously, interface between adjacent wall segments (52A-E) is then filled with a thin layer of mortar (less than ½ inch thick, or about ¼ inch thick).

The thickness of mortar layers throughout the reactor may vary. For example, in the areas of heavy work (in terms of conversion zone in the reaction unit, typically the lower portion of the unit), thick dense monolithic rings are placed upon the floor component(s) with a very thin (⅛") mortar joint for example. In other areas, thicker mortar layers are used (e.g., ¼").

Figure 11:
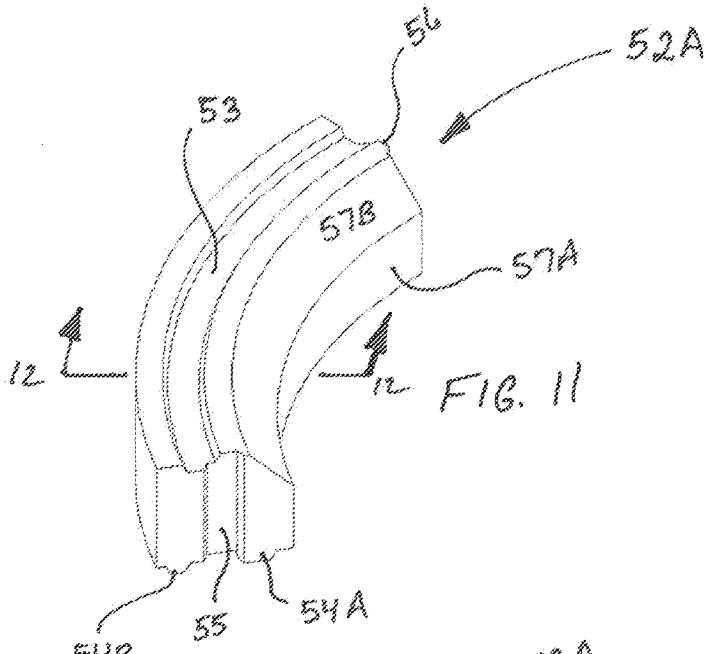
FIG. 11 depicts a segment of yet another embodiment of a wall module for use in the fluidized bed system of FIG. 1.
Figure 12:
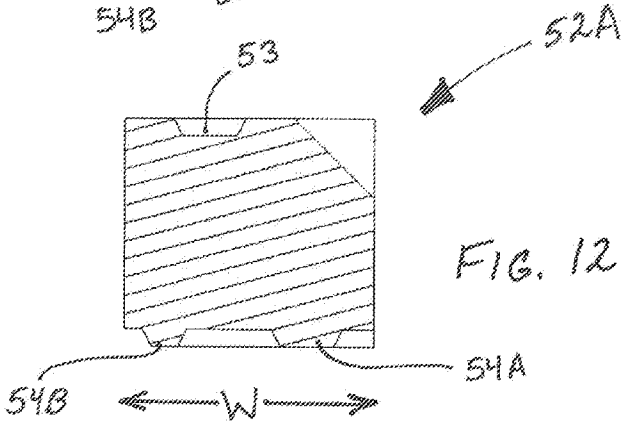
FIG. 12 depicts a cross-sectional view of the insulating module of FIG. 11.

It will be noted from FIGS. 2, 11 and 12 that intermediate wall module (52) also includes a cylindrical, constant diameter lower portion (57A) and an upper portion (57B) having an outwardly tapered interior circumference. Of course this is merely exemplary of one possible embodiment, and it will be understood that intermediate wall module (52) may have a constant interior circumference, or one or more tapered portions which taper inwardly or outwardly.

In the particular embodiment shown in FIGS. 1 and 2, no secondary insulating modules are provided above intermediate wall module (52). However, dry vibratable refractory (34) is still provided between the outer surface of the intermediate and upper wall modules (58, 64, 66) and the inner surface of the shell (12).

A pair of segmented first and second upper wall modules (58) are located above intermediate wall module (52), as shown, and include the interlocking features described previously with respect to intermediate wall module (52). For example, one of the side endwalls of first and second upper wall modules (58) include a groove (59) arranged for mating engagement by a corresponding projection (or ridge) on the opposite side endwall of an adjacent upper wall module (58). First and second upper wall modules (58) each comprise three segments (58A-C) joined in mating engagement with one another, although it will be understood that any number of segments may be employed (e.g., 2 to 5).

Third upper wall module (also known as a transition module) (62) is located atop the second upper wall module (58), and is configured similar to intermediate wall module (52). Thus, wall module (62) includes a pair of circumferential projections, concentric to each other and extending downwardly from the bottom endwall of the wall segments (62A-D). The first, innermost circumferential projection is configured for mating engagement with the circumferential groove in the upper surface of second upper wall module (58). The second outerrmost circumferential projection (63) is configured to be received between the outer wall of wall module (58) and the upper end of sidewall (14) of shell (12), directly above the dry vibratable refractory material between the wall modules and the shell (12) (see FIG. 2). There is no groove or projection on the upper endwall of module (62), as it does not interlock with adjacent module (64). In fact, in the depicted embodiment, there is no flat upper endwall on module (62). Module (62) is intended to expand in the vertical direction during use. A gap of, for example, about ⅜" is provided between the outer circumference of module (62) and the inner circumference of module (64), and this gap is filled with mortar during assembly. In addition, module (62) comprises four segments (62A-D) joined in mating engagement with one another in the manner described previously, although it will be understood that any number of segments may be employed (e.g., 2 to 5).

Finally, fourth and fifth upper modules (64, 66) are provided above transition module (62). Fourth upper module (64) is located atop flange (20) of the shell (12), and has a flat bottom endwall and a circumferential groove in its upper endwall for engagement with a mating circumferential projection on the bottom endwall of fifth upper module (66), as shown. Fourth and fifth upper modules (64, 66) are once again segmented, in the example shown having four interlocking segments, configured in the manner previously described. Dry vibratable refractory material is also located between the exterior circumference of fourth and fifth upper modules (64, 66) and the inner wall of upper sidewall (18) of shell (12). A passageway (67) in communication with port (29) is also provided on one of the module segments (66C).

As best seen in FIG. 1, the vertical seams between adjacent segments of a wall module are offset the vertical seams of an adjacent row of module segments in order to increase strength of the assembly and prevent a mortar crack from propagating from one module to the next.

Figure 13:
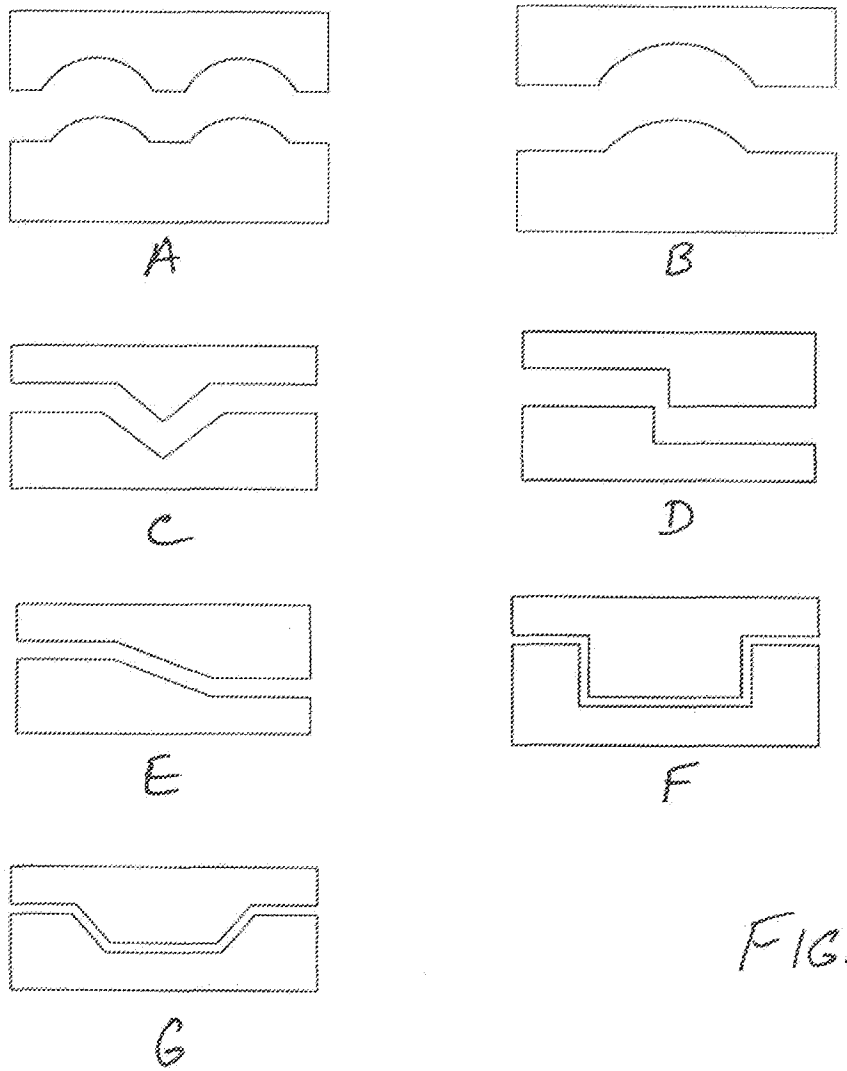
FIG. 13 depicts various alternative interlocking surfaces for use in the wall modules of the fluidized bed system of FIG. 1.

FIG. 13 schematically depicts a variety of alternative interlocking joints which may be used in place of the groove and projection (or ridge) arrangement described previously. FIG. 13A, for example, depicts a double groove and corresponding double ridge arrangement, wherein each has an arcuate cross-sectional shape. FIG. 13B is a single arcuate groove and arcuate projection arrangement, while in FIG. 13C the groove and ridge are triangular. FIG. 13D is a rabbet or shiplap joint, while FIG. 13F is similar to those described previously herein but with a more substantial size to the groove and mating ridge. In FIG. 13G, the groove and ridge have a trapezoidal shape. Finally, FIG. 13E depicts a sloped arrangement where the mating surfaces have a non-linear engagement—in this instance a central sloped region.

Figure 14:
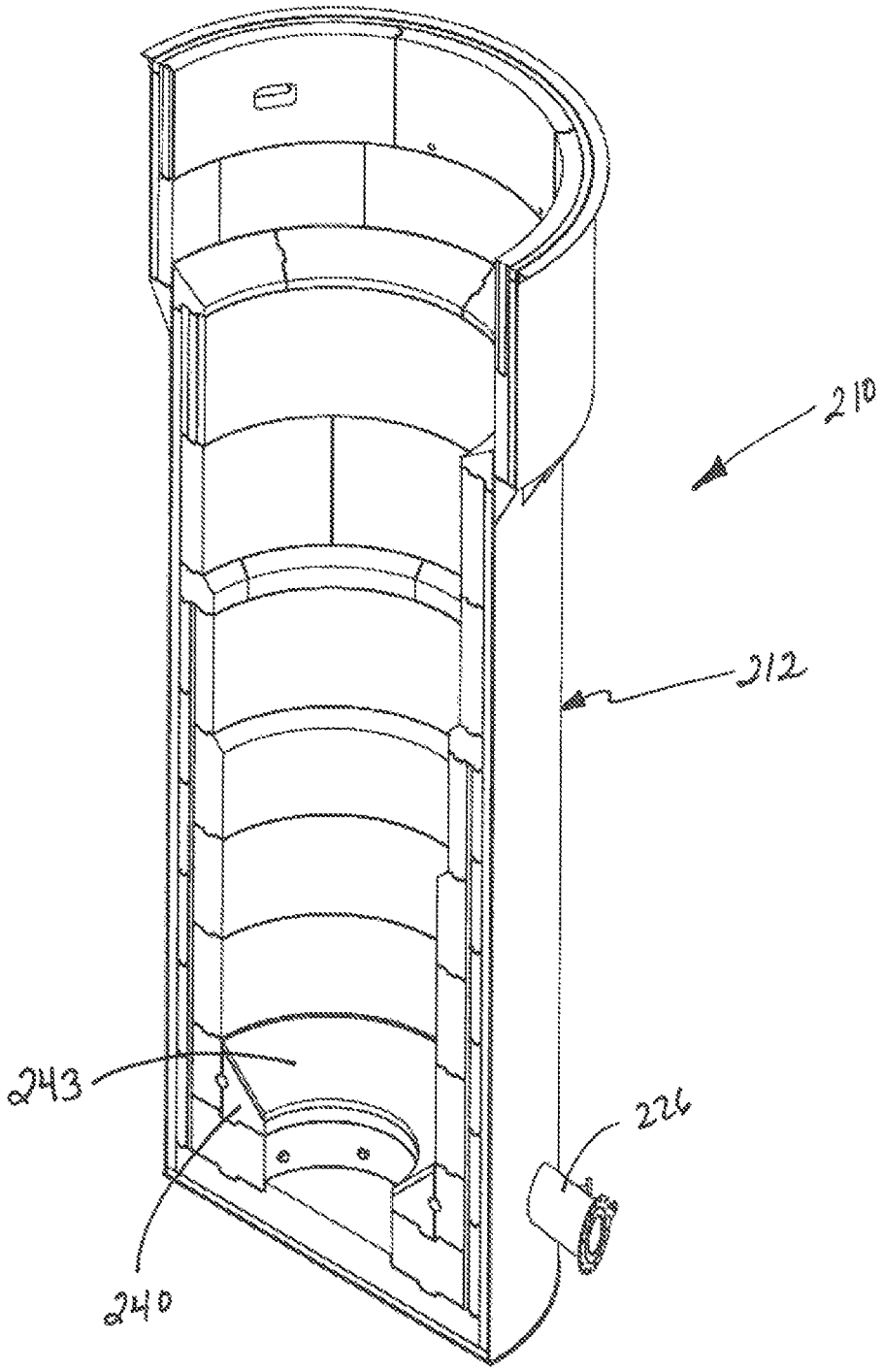
FIG. 14 depicts an elevational cross-sectional view of an alternative embodiment of a fluidized bed system.
Figure 15:
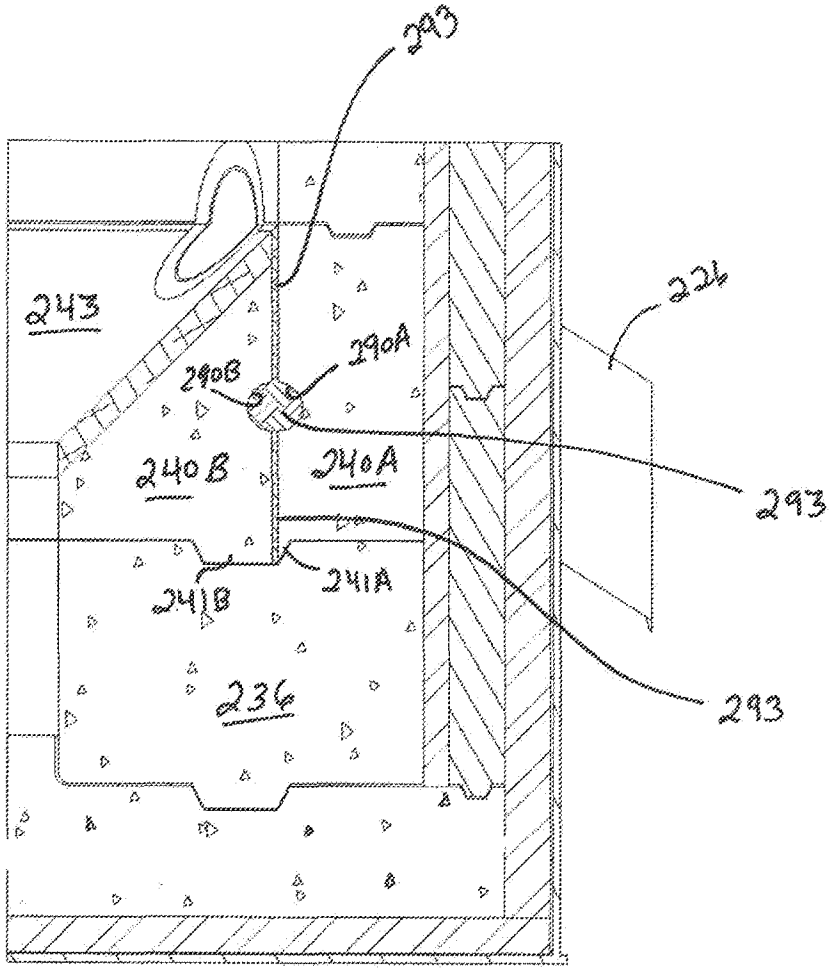
FIG. 15 depicts a cross-sectional view of a portion of the fluidized bed system of FIG. 14.

FIGS. 14 and 15 depict an alternative arrangement which is similar to that shown in FIGS. 1-3. In this embodiment, second wall module (240) includes a replaceable portion (240B) and a permanent portion (240A). In addition, the tapered surface of the second wall module includes a wear-resistant coating (243) (e.g., a ceramic layer) adhered to the replaceable portion (240B), as shown. The wear-resistant coating (243) is configured to provide greater strength and wear resistance during use. In addition, not only is a mortar-fillable gap provided between the replaceable portion (240B) and the permanent portion (240A) of second wall module (240), female indentations (290A, 290B) are provided in the mating surfaces of the replaceable and permanent portions (240A, 240B), extending around the circumference of the adjacent surfaces. Upon initial installation, mortar (293) is filled into this region, as shown, as well as between the other adjacent surfaces of the replaceable and permanent portions (240A, 240B). When wear-resistant coating is worn, the mortar (293) is chipped away and the replaceable portion is removed and replaced.

Figure 16:
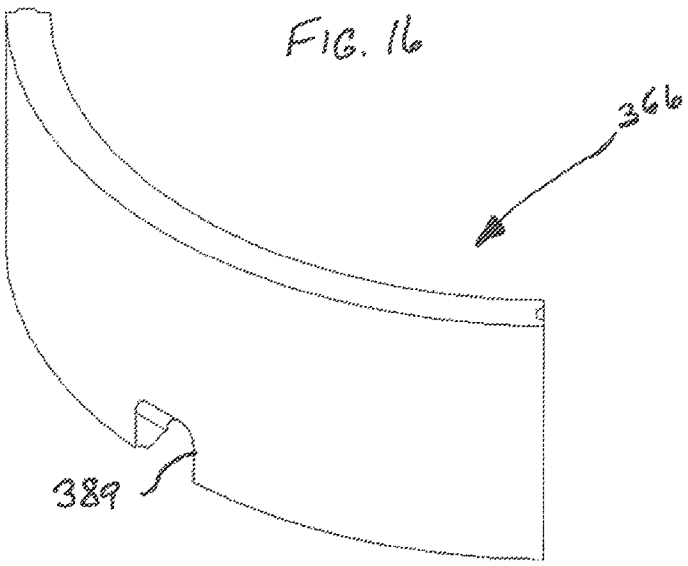
FIG. 16 depicts a segment of yet another embodiment of a wall module for use in the fluidized bed system of FIG. 1.

FIG. 16 depicts an alternative configuration of a wall module segment (366) which may be used in various embodiments of the reactor systems described herein, such as in place of wall module segments (66A-D). Wall module segment includes interlocking surfaces for assembling into a ring, as described previously, as well as a circumferential ridge extending downwardly from the bottom endwall of the segment. A precast opening (389) is also provided in wall module segment (366), and may be used to accommodate, for example, monitoring equipment and the like.

Figure 18:
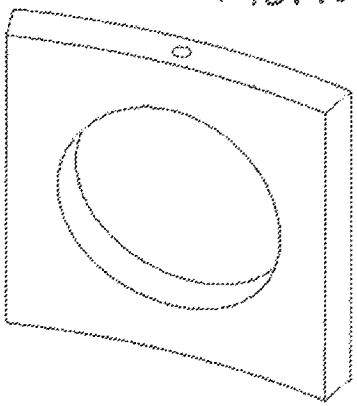
FIGS. 17 and 18 depict views of one embodiment of a feed port opening for use in the fluidized bed system of FIG. 1.
Figure 17:
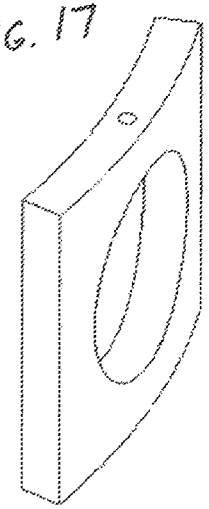

FIGS. 17 and 18 depict views of one embodiment of a feed port opening. Like the other refractory modules described herein, lifting into place can be accomplished with a clamping system or anchor inserts. This particular feed port component shown in FIGS. 17 and 18 is arched, approximately 10 feet in length and 3 feet in height and 2-6 inches in thickness. This embodiment does not include the interlocking key system as in the previously-described modules because it is configured to be recessed into a cut out in the adjacent sidewall shapes, however, it can be configured to include the previously-described interlocking features.

Figure 19:
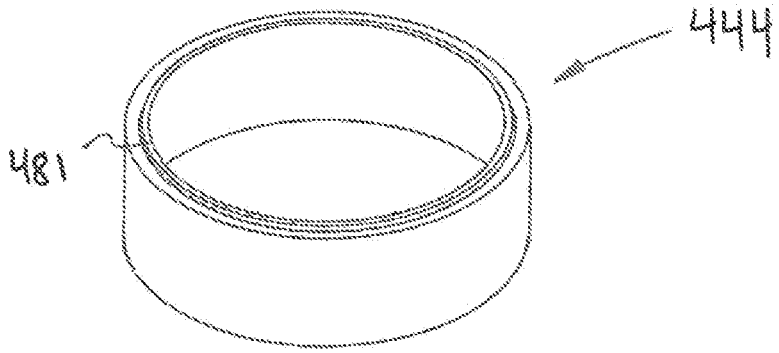
FIG. 19 depicts a further embodiment of a wall module for use in the fluidized bed system of FIG. 1.
Figure 20:
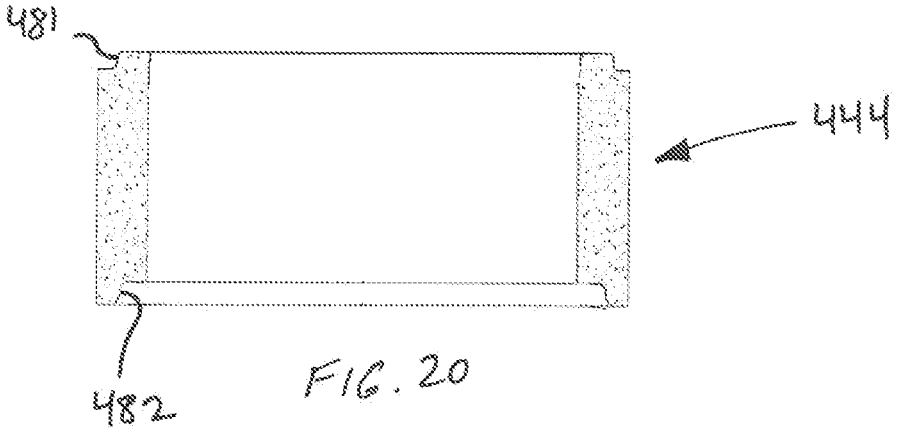
FIG. 20 depicts a cross-sectional view of the wall module of FIG. 19.

FIGS. 19 and 20 depict and alternative embodiment of a unitary wall module (444) which may be used, for example, in place of wall modules (44) previously described herein. Wall module (444) includes a circumferential flange (481) which extends around the entire periphery of the upper endwall, along the inner edge thereof. A corresponding mating shoulder (482) is provided in the bottom endwall of the module (444) in order to guide and facilitate module stacking. This arrangement provides a shiplap (or rabbet) joint between the stacked modules.

Wall module (444), as well as one or more of the other unitary wall modules and/or insulating wall modules (70) described previously herein, may also include a wound, continuous fiber tensile reinforcement structure integrated within the module sidewall, as described and shown in U.S. Patent Pub. No. 2014/0038119 A1 (published on Feb. 6, 2014), which is incorporated by reference herein. As described in U.S. Patent Pub. No. 2014/0038119 A1, module wall failure can be reduced (e.g., delayed or, in some cases, prevented entirely) by integrating a tensile, wound continuous fiber reinforcement structure with the ring-shaped module. The preform is formed by co-winding one or more continuous, unbroken fiber tows about a mandrel. The wound fiber reinforcement structure is referred to herein as a "preform," since it is formed separately from the refractory module, and then integrated with the refractory module during casting (i.e., molding) of the refractory module. In some embodiments, the fiber preform is located entirely within one or more walls of the module such that it is not visible, while in other embodiments the preform is embedded at least partially within in one or more outer walls of the module. Partially embedded means that at least some portion of the fiber tows extend outwardly away from the outer surface of the module wall, while fully embedded means that the outer surface of the module is smooth (the fiber tows do not protrude from the refractory outer surface) yet at least a portion of the tows are visible. And in still further embodiments portions of the fiber preform may be entirely within one or more walls of the module, while other portions are embedded in one or more walls of the module.

As an alternative to having separate wall and insulating modules, with a dry vibratable therebetween (or in addition thereto), the wall module can be cast as two or more concentric layers having different properties. Thus, instead of pouring a single, uniform castable material into a suitably shaped mold, a first castable A is poured in a mold with an insert positioned therein which segments the interior of the mold into two concentric, annular regions, or stacked annular regions. When the first castable A has dried, or reaches initial set, a second castable material B is poured into the other annular region of the mold interior, either in front of material A, behind it or over it. In this manner, a single cast module may have different properties in different regions, such as a higher density central region, surrounded by a less dense outer region.

The size of the various wall modules herein may vary as necessary or desired. In some embodiments, for example, wall modules are 20 to 50 inches tall, 10-14 feet in outer side wall diameter and have a wall thickness of about 6 to 12 inches. The modules can be cast from a variety of dense refractory material.

The precast and predried monolithic modules can be made with any known or hereafter developed refractory castable materials and compositions, including compositions requiring vibration for flowing as well as those having self-flow consistency. In addition, conventional molding and firing processes and steps may be used, as known to those skilled in the art or hereafter developed.

The modules may be formed of any suitable refractory material, including, but not limited to, low cement, ultralow cement and cement-free monolithic castables. In some embodiments, the alumina content of the material is selected based upon the maximum corrosion resistance required in each of the zones of the reactor. For example, in one specific embodiment, lower alumina products containing about 45-70% by weight alumina are employed for the reactor flooring modules and lower wall modules (e.g., below intermediate module (52)), and higher alumina products containing about 90-95% by weight alumina are employed in upper wall modules (e.g., above intermediate module (52).

In still further embodiments, suitable raw materials for the refractory castable include any known to those skilled in the art such as SiC, alumina, silica, magnesia, graphite, aluminosilicates, zircon-containing materials, chrome aluminates, magnesium aluminates, and alumina-zirconia silicates. One or more of these materials may be included in the castable composition, including both dense and insulating compositions (i.e., classic refractory aggregates). The castable compositions may also include various organic burn-out fibers or non-organic fibers known to those skilled in the art.

Other suitable castables include those described in U.S. Pat. Pub. No. 2012/0052196 A1, published on Mar. 1, 2012, titled Monolithic Graphitic Castable Refractory, which is incorporated herein by reference. The refractory composition is mixed with water and then poured, pumped, injected, sprayed or otherwise added to a suitable mold for the module.

In one example, a graphite-based monolithic refractory castable material of the type described in U.S. Pat. Pub. No. 2012/0052196 A1 is employed. In some embodiments, the graphite is synthetic graphite, although other types of graphite, for example super graphite comprising crushed double densified graphite, or the like may be used. The graphite-based monolithic refractory castable material comprises from about 25 to about 80 weight percent of graphite, more specifically, from about 40 to about 80 weight percent of graphite, or, more specifically, from about 50 to about 70 weight percent of graphite, is used. (Unless otherwise stated, all weight percentages described herein are based on the weight of the monolithic refractory castable material, prior to mixing with water.) The graphite provides the compositions with good thermal conductivity. In a specific embodiment, after casting the refractory module using such graphite-based castable materials, the module is prefired in coke.

In addition to about 25 to about 80 weight percent of graphite, the castable material also includes from about 1 to about 15 weight percent of a water dispersible, curable phenolic novolac resin, and from about 70 to about 15 weight percent of one or more refractory aggregates (based on the weight of the monolithic refractory castable composition prior to mixing with water). Suitable phenolic novolac resins are known in the art and available from, for example, Hexion Specialty Chemicals, formerly Borden Chemical, under the Durite® line of products. See for example, U.S. Pat. No. 6,046,252, which describes a water dispersible mixture of Durite® phenolic novolac resins of molecular weight 1000-1300 and molecular weight of 4000-8000 (2:8 weight ratio). Typically, the water dispersible phenolic novolacs resins are rendered curable by the inclusion of a curing agent therein. One suitable curing agent is hexamethylenetetramine ("hexa") which often is included in commercially available phenolic novolac resin, for example in an amount of about 1-10 weight percent, based on the weight of the resin, or, more specifically in an amount of about 4-6 weight percent, based on the weight of the resin. The resins are typically used in dry powder form and are included in the castable compositions described herein in an amount of from about 1 to about 15 weight percent, or, more specifically, from about 5 to about 10 weight percent of the weight of the phenolic novolac resin.

The above-described monolithic refractory castable material further comprises one or more refractory aggregates in order to provide, inter alia, abrasion resistance and, optionally, other desired properties. The monolithic refractory castable materials typically comprise from about 70 to about 15 weight percent of the one or more refractory aggregates, or, more specifically, from about 50 to about 15 weight percent, or, more specifically, from about 35 to about 15 weight percent of the one or more refractory aggregates. In a specific embodiment, the one or more refractory aggregates comprise carbon black, pitch (natural and/or synthetic), SiC, $Al_2O_3$, $Cr_2O_3$, $ZrO_2$, $TiO_2$, $Si_3N_4$, $B_4C$, TiC, $CaO.6Al_2O_3$, $Si_2ON_2$ (silicon oxynitride), Sialon (ceramic alloys based on silicon, aluminum, oxygen and nitrogen), aluminum metal powder, copper metal flake, or silicon metal powder, or a mixture of two or more thereof. In another specific embodiment, the one or more refractory aggregates comprise from about 1 to about 40 weight percent SiC, and from about 1 to about 10 weight percent carbon black, pitch, $Al_2O_3$, $Cr_2O_3$, $ZrO_2$, $SiO_2$, $TiO_2$, $Si_3N_4$, $CaO.6Al_2O_3$, $B_4C$, TiC, $Si_2ON_2$, Sialon, aluminum metal powder or silicon metal powder, or a mixture of two or more thereof, based on the weight of the monolithic refractory castable material (prior to mixing with water).

These monolithic refractory castable materials may optionally further comprise other materials conventionally employed in refractory materials for their known advantages, as desired. For example, the monolithic refractory castable materials may comprise up to about 10 weight percent of silica fume and/or up to about 10 weight percent of calcium aluminate and/or calcium oxide. Optionally, the monolithic refractory castable material may further comprise a dispersant, either organic or inorganic, or a mixture thereof, in an amount up to about 1 weight percent, or, more specifically, up to about 0.1 weight percent.

A sufficient amount of water is added to render the mixture castable. In one embodiment, the monolithic refractory castable material is mixed with from about 1 to about 25 weight percent water, based on the weight of the monolithic refractory castable material. In a specific embodiment, the monolithic refractory castable material is mixed with from about 5 to about 15 weight percent water, based on the weight of the monolithic refractory castable material.

In one specific example, a refractory castable material is prepared comprising, on a weight basis, about 64% synthetic graphite, about 19% silicon carbide, about 6% alumina, about 2% calcium oxide, and about 9% water dispersible, curable phenolic novolac resin. This mixture is then combined with water and poured into a suitably shaped mold. After curing of the refractory composition, the module is removed from the mold and, for example, prefired in coke (e.g., to 2200° F. for 2 hours). During prefiring, the binder used in the fiber belt is volatilized.

Selection of the refractory castable will depend on a variety of factors, such as anticipated operating temperatures, reactor size, materials to be processed in the reactor, etc. In addition, any of variety of bonding materials are similarly included in some embodiments of the castable composition, including calcium aluminate cement, colloidal silica, alumina, high surface area alumina, high surface area silica, sulfates, resins, phosphates, and nitrogen bonders. In fact, since the tensile preform supplies the desired hoop stress, the tensile preform provides greater flexibility in the choice of bonding materials and other components of the castable composition.

The dry vibratable monolithic refractory is used in some embodiments to fill any imperfections in contact surfaces or can be designed to be a layer between the precast modules. In an additional embodiment, the working lining and backup lining rings can be zoned into one module instead of being separate modules by mating or zoning to the dense hot face.

Suitable dry vibratable refractory materials are disclosed in the Doza et al U.S. Pat. Nos. 6,458,732 and 6,893,992, both of which are incorporated herein by reference. The dry vibratable refractory is a dry powder composition and can be employed to fill gaps between a module and the adjacent steel shell or insulating module. For example, dry vibratable refractory may be installed under floor module(s) and/or between the wall modules and the steel shell.

The dry vibratable refractory avoids addition of water to the system, and therefore avoids a drying step, and by specifically designing the sintering profile of the dry vibratable refractory, the dry vibratable refractory also allows for easier removal of worn wall modules during repair or replacement processes. That is, if the dry vibratable refractory adjacent the steel shell has not been sintered, it remains in powder form and allows easier tear out of the components upon rebuild, without shell damage, and selective top of reactor repairs with re-backfill and compaction of the dry vibratable. Tear out of damaged refractory bricks in conventional cells often deforms and warps the steel containment structure, resulting in divots and buckles. Installing modules without a flush wall will leave gaps behind the brick, which, as noted, can result in the refractory lining shifting during operation, resulting in the formation of cracks into which reactants can infiltrate. The dry vibratable refractory can therefore provide a solution to both leak containment and irregularities in the steel shell walls. An additional advantage of using dry vibratable refractory is the reduction in installation time compared to installation of secondary layers of brick. Bags can be opened, emptied into the space between the steel shell, for example, in bulk up to 3600 pounds at a time, if necessary, and compacted at a fraction of the time for assembling a brick wall.

The dry vibratable refractory may comprise an insulating dry vibratable material or a dense vibratable refractory material. Specific examples include, but are not limited to, chamotte, sintered mullite, fused mullite, lightweight mullite, bauxite, and andalusite, along with the materials disclosed by Doza et al, U.S. Pat. Nos. 6,458,732 and 6,893,992, noted above. In a specific embodiment, the dry vibratable material has a sufficient bonding property to sinter to a solid mass when exposed to molten salt. In a more specific embodiment, the dry vibratable material contains about 45-70% by weight alumina.

In specific embodiments, dry vibratable refractory floor material may be provided under the at least one precast and predried monolithic refractory flooring module. In another embodiment, dry vibratable refractory material is installed between the wall modules and the walls of the steel shell. In a more specific embodiment, the wall modules comprise lower wall modules which have surfaces adjacent to and interlocking with the floor module(s) and upper wall modules which have surfaces adjacent to and interlocking with the lower wall modules. Dry vibratable refractory material may be installed between the lower wall modules and the wall of the steel containment shell, after which the upper wall modules are installed, and dry vibratable refractory material is installed between the upper wall modules and the wall of the steel containment shell.

In further embodiments, a microporous, mica-covered insulating layer may be provided adjacent to the steel containment shell, arranged between the steel shell and modules, or, in an embodiment where dry vibratable refractory material is employed, between the steel shell and the dry vibratable refractory. The use of a microporous insulation board, covered in a mica sheet, reduces the effects of reactants on the inside of the steel shell. The microporous board-mica combination creates an impervious layer that reduces, if not stops, the potential for reactant to migrate and corrode the shell, reducing shell repairs related to corrosion. Additionally, the microporous board-mica combination provides a thermal barrier which reduces heat loss. One suitable material which is commercially available is Elmtherm 1000 MP from Elmelin Ltd, London, England, in which the microporous board is formed of SiO2, SiC and CaO. One skilled in the art will appreciate that microporous boards of other heat-resistant and corrosion resistant materials may be employed as well.

In specific embodiments, a microporous, mica-covered insulating floor layer is provided and the dry vibratable refractory floor material is installed on the microporous, mica-covered insulating floor layer. In another embodiment, a microporous, mica-covered insulating layer is provided between the steel shell walls and the dry vibratable refractory material adjacent the wall modules.

While several devices and components thereof have been discussed in detail above, it should be understood that the components, features, configurations, and methods of using the devices discussed are not limited to the contexts provided above. In particular, components, features, configurations, and methods of use described in the context of one of the devices may be incorporated into any of the other devices. Furthermore, not limited to the further description provided below, additional and alternative suitable components, features, configurations, and methods of using the devices, as well as various ways in which the teachings herein may be combined and interchanged, will be apparent to those of ordinary skill in the art in view of the teachings herein.

Having shown and described various versions in the present disclosure, further adaptations of the methods and systems described herein may be accomplished by appropriate modifications by one of ordinary skill in the art without departing from the scope of the present invention. Several of such potential modifications have been mentioned, and others will be apparent to those skilled in the art. For instance, the examples, versions, geometrics, materials, dimensions, ratios, steps, and the like discussed above are illustrative and are not required. Accordingly, the scope of the present invention should be considered in terms of the following claims and is understood not to be limited to the details of structure and operation shown and described in the specification and drawings.

What is claimed is:

1. A fluidized bed system comprising:

(a) a containment vessel;

(b) a precast and predried monolithic refractory floor module positioned in said vessel;

(c) a plurality of precast and predried monolithic refractory wall modules stacked within said vessel, wherein said wall modules are ring-shaped and have inner and outer circumferences, and further wherein said plurality of wall modules includes a first wall module in the form of a unitary ring positioned on said floor module;

(d) a plurality of precast and predried monolithic refractory insulating modules stacked within said vessel and positioned about the outer circumference of said wall modules;

(e) a dry vibratable refractory material located between the outer circumference of said wall modules and said insulating modules; and (f) a dry vibratable refractory material located between the outer circumference of said insulating modules and said containment vessel;

wherein the floor module and said first wall module have interlocking surfaces, and wall modules adjacent to one another have interlocking surfaces.

2. The fluidized bed system of claim 1, wherein at least one of said wall modules is configured to provide an input port for reactants or an output port for product.

3. The fluidized bed system of claim 1, wherein an input port for reactants is provided on at least one of said wall modules and an output port for product is provided on at least one of said wall modules.

4. The fluidized bed system of claim 1, wherein the modules are formed of a refractory material comprising low cement, ultra low cement or cement-free monolithic castable.

5. The fluidized bed system of claim 1, wherein said floor module includes a circular central raised portion having an outer circumference which is less than the inner circumference of the first wall module such that said central raised portion facilitates alignment of the first wall module on the floor module.

6. The fluidized bed system of claim 1, wherein at least one of said wall modules comprises two or more monolithic ring segments joined along interlocking sidewalls.

7. The fluidized bed system of claim 6, wherein at least one of said wall modules has a tapered inner circumference.

8. The fluidized bed system of claim 1, wherein a circumferential groove is provided on one endwall of two or more of said modules, and a mating circumferential ridge is provided on the opposite endwall of said two or more of said modules.

9. The fluidized bed system of claim 1, wherein each of said wall modules comprises either (a) a unitary ring, or (b) two to five monolithic ring segments joined to one another along interlocking sidewalls.

10. The fluidized bed system of claim 9, wherein said insulating modules are ring-shaped and insulating modules adjacent to one another have interlocking surfaces.

11. The fluidized bed system of claim 10, wherein the interface between adjacent insulating modules is vertically offset from the interface between adjacent wall modules.

12. The fluidized bed system of claim 9, wherein said plurality of insulating modules includes a first insulating module positioned on said floor module, and further wherein the floor module and said first insulating module have interlocking surfaces.

13. The fluidized bed system of claim 9, wherein said plurality of wall modules includes a lower section of wall modules in the form of unitary rings stacked upon said first wall module, and at least one additional wall module located above said lower section, said at least one additional wall module comprising two to five monolithic ring segments joined to one another along interlocking sidewalls.

14. The fluidized bed system of claim 13, wherein said at least one additional wall module is stacked atop both the upper-most wall module of said lower section and the upper-most one of said insulation modules.

15. A method for assembling a fluidized bed reactor comprising:

(a) providing a containment vessel, (b) installing a precast and predried monolithic refractory floor module in said vessel;

(c) stacking a plurality of ring-shaped, precast and predried monolithic refractory wall modules and insulation modules in said vessel, wherein said insulation modules are positioned about and spaced away from the outer circumference of said wall modules, and further wherein said plurality of wall modules includes a first wall module in the form of a unitary ring that is positioned on said floor module; and (d) installing dry vibratable refractory material in the space between the wall modules and the insulation modules;

wherein the floor module and said first wall module have interlocking surfaces, wall modules adjacent to one another have interlocking surfaces, and insulation modules adjacent to one another have interlocking surfaces.

16. The method of claim 15, further comprising the step of installing a dry vibratable refractory material on which the floor module is installed.

17. The method of claim 15, further comprising the step of installing dry vibratable refractory material between the insulation modules and the interior of the containment vessel.

18. The method of claim 17, further comprising the step of installing a microporous, mica-covered insulating layer adjacent to the interior of the containment vessel, wherein dry vibratable refractory material is installed between the insulation modules and the microporous, mica covered insulating layer.

19. A fluidized bed reactor comprising:

(a) a containment vessel;

(b) a precast and predried monolithic refractory floor module positioned in the bottom of said vessel; and (c) a plurality of ring-shaped, precast and predried monolithic refractory wall modules stacked within said vessel, wherein said plurality of wall modules includes a first wall module positioned on said floor module;

(d) a plurality of ring-shaped precast and predried monolithic insulating modules stacked within said vessel and positioned about the outer circumference of said plurality of wall modules such that an annular space is provided between the plurality of insulating modules and the plurality of wall modules; and (e) a dry vibratable refractory material that fills said annular space between the plurality of insulating modules and the plurality of wall modules;

wherein the floor module and said first wall module have interlocking surfaces such that an interlocking joint is provided between the floor module and the first wall module, and wall modules adjacent to one another have interlocking surfaces such that an interlocking joint is provided between adjacent wall modules;

and further wherein each of said wall and insulation modules comprises either (a) a unitary ring, or (b) two to five monolithic ring segments joined to one another along interlocking sidewalls, with said first wall module comprising a unitary ring.

* * * * *